United States Patent [19]

Buoli

[11] Patent Number: 4,875,025

[45] Date of Patent: Oct. 17, 1989

[54] MICROSTRIP TRANSMISSION LINE FOR COUPLING TO A DIELECTRIC RESONATOR

[75] Inventor: Carlo Buoli, Mirandola, Italy

[73] Assignee: Siemens Telecomunicazioni S.p.A., Milan, Italy

[21] Appl. No.: 44,011

[22] Filed: Apr. 29, 1987

[30] Foreign Application Priority Data

May 14, 1986 [IT] Italy ..... 20428 A/86

[51] Int. Cl.[4] ..... H01P 7/06

[52] U.S. Cl. ..... 333/230; 333/219; 331/117 D; 331/107 SL

[58] Field of Search ..... 333/219, 230, 227, 222, 333/223, 228, 231; 331/96, 97, 107 DP, 107 SL, 117 D

[56] References Cited

U.S. PATENT DOCUMENTS

| | | | |
|---|---|---|---|
| 2,901,709 | 8/1959 | Fitzmorris | 333/116 X |
| 2,976,499 | 3/1961 | Sferrazza | 333/116 X |
| 3,760,304 | 9/1973 | Cohn | 333/219 X |
| 4,211,987 | 7/1980 | Pan | 333/230 |
| 4,523,159 | 6/1985 | Dobrovolny | 333/247 X |

FOREIGN PATENT DOCUMENTS

| | | | |
|---|---|---|---|
| 0012553 | 1/1979 | Japan | 331/107 SL |
| 0034702 | 2/1984 | Japan | 331/107 SL |
| 0134608 | 7/1985 | Japan | 331/96 |
| 0978311 | 11/1982 | U.S.S.R. | 331/117 D |

*Primary Examiner*—Eugene R. Laroche
*Assistant Examiner*—Seung Ham
*Attorney, Agent, or Firm*—Cushman, Darby & Cushman

[57] ABSTRACT

The structure includes a conductive path and a ground plane applied to opposite faces of an insulating support. The ground plane has parallel slots placed under the conductive path and transversely thereto.

8 Claims, 2 Drawing Sheets

MICROSTRIP TRANSMISSION LINE FOR COUPLING TO A DIELECTRIC RESONATOR

Figure 1:
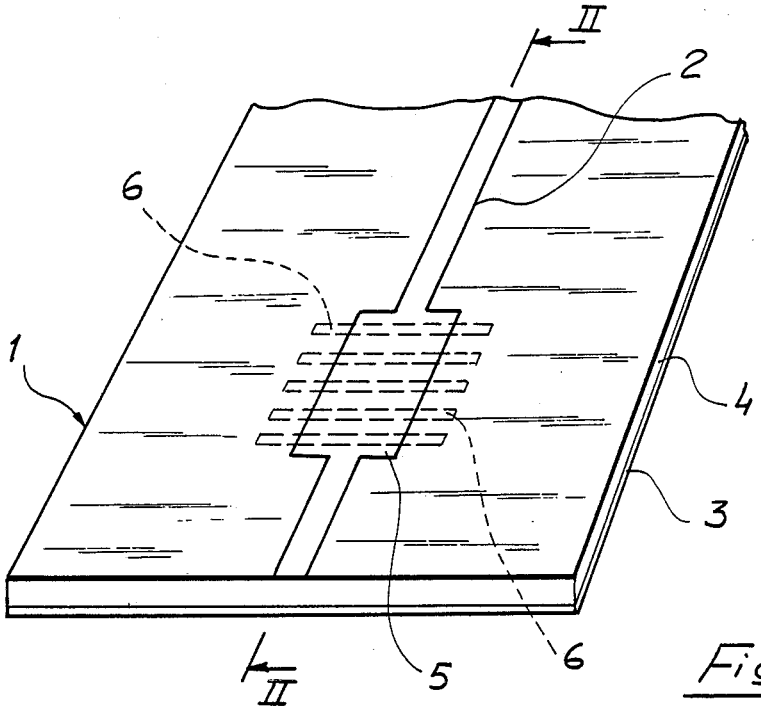

The present invention relates to a microstrip transmission line for coupling to a dielectric resonator.

In some electronic equipment such as microwave oscillators stabilized by a dielectric resonator there is the necessity of coupling the dielectric resonator to a microstrip transmission line.

The latter is normally made up of a conductive path or microstrip of appropriate width placed on one face of an insulating support made of alumina or glass fibre which bears on the opposite face a metallic layer or ground plane.

The dielectric resonator is placed adjacent to the transmission line in such a manner as to couple electrically therewith.

For good coupling the resonator must be very close to the line. In this manner it tends however to modify the characteristic impedance of the transmission line, which should remain constant at the predetermined value. At the same time the proximity of the line influences in an undesirable manner the resonance frequency and the Q-factor of the dielectric resonator.

In accordance with a known solution to the above problem the coupling between the resonator and the line can be increased without excessively approaching the resonator to the line, undercutting the ground plane beneath the conductive path, i.e. removing metal from said plane. This is achieved by opening in the ground plane a window more or less in rectangular form under the conductive path the width of which is in turn increased in such a manner as to hold the characteristic impedance steady.

This structure, termed "suspended microstrip", has the drawback of generating a widely diffused electromagnetic radiation which is dispersed outside the area involved in the coupling with the resonator, also influencing the rest of the circuit.

The object of the present invention is to accomplish a microstrip transmission line which could be profitably coupled with a dielectric resonator located at a distance without however the occurence of reciprocal influences between the line and the resonator and without alteration of the electrical properties of the microstrip and the dielectric resonator.

In accordance with the invention said object is achieved by means of a microstrip transmission line comprising a conductive path and a metallic ground plane applied to opposite faces of an insulating support characterized in that the ground plane has a plurality of parallel slots placed under said conductive path and transversely thereto.

In other words, the transmission line in accordance with the invention provides for the ground plane a grooved structure or "slot line" which allows the microstrip to couple with the dielectric resonator and exchange energy with it not directly but through and coincidently with the slots in the ground plane.

The slots thus function as antennas, allowing the dielectric resonator to remain at a distance from the transmission line. This is very useful for maintaining unchanged the dielectric characteristics such as the Q-factor and frequency stability, which would otherwise be altered by the presence of a very close line. What happens on the line does not influence the dielectric resonator and vice versa. The energy exchange takes place only at the resonance frequency of the dielectric when the electromagnetic energy increases significantly. At the same time the slots, which are easy to make in a form as narrow as desired, do not influence the general structure and the functions of the ground plane, which still appears substantially unbroken in such a manner as to avoid disturbances of the microstrip. The characteristic impedance of the transmission line can be maintained constant at the desired value by compensating with greater width of the conductive path, hence with greater capacitance, for the concentrated inductances represented by the ground plane slots.

Figure 2:
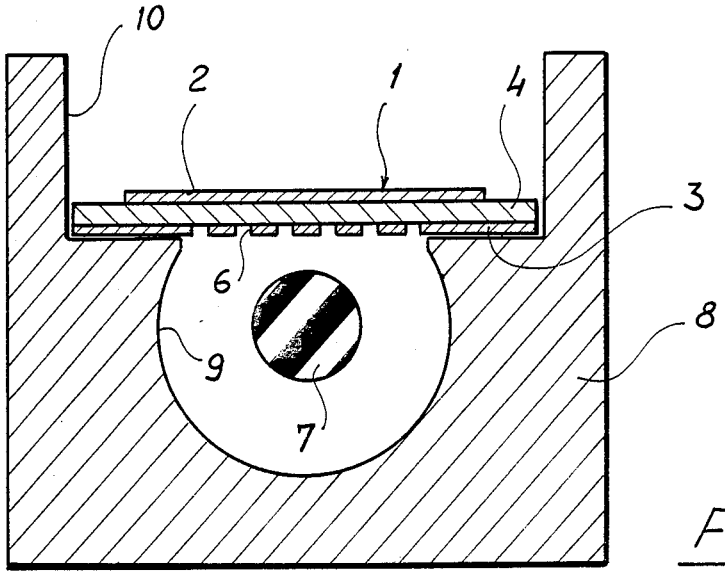
Figure 3:
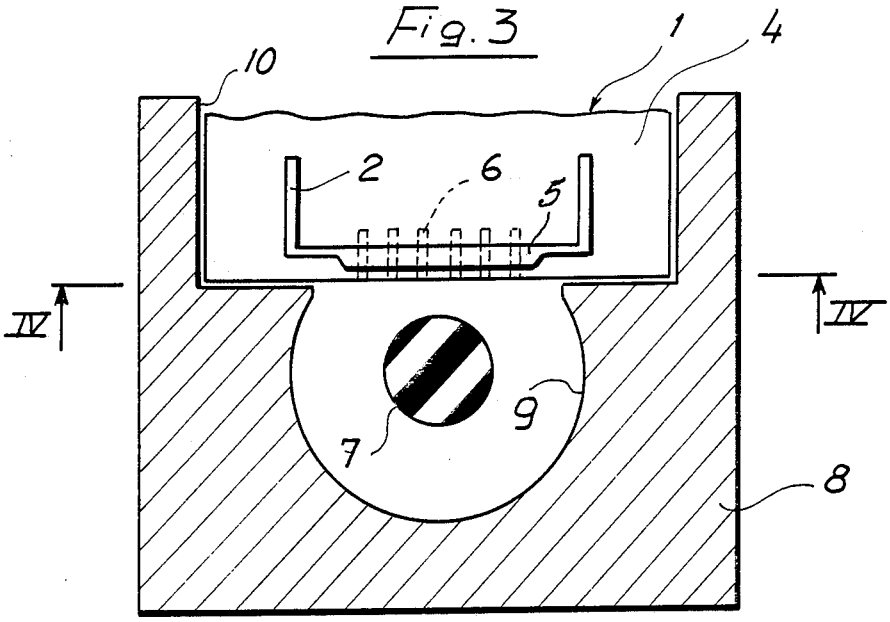
Figure 4:
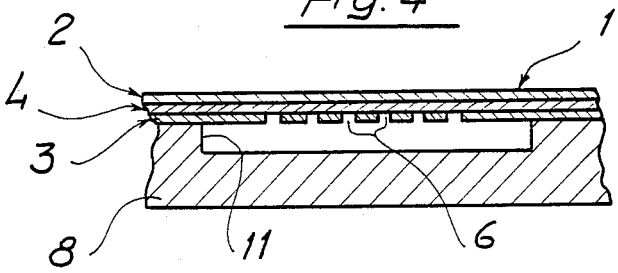
Figure 5:
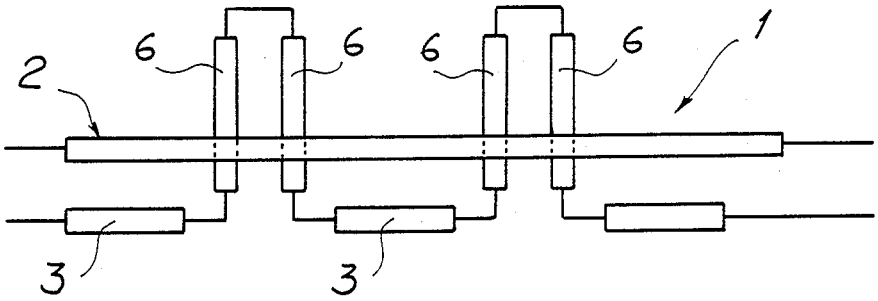

The features of the present invention will be made clearer by the following detailed description of its possible embodiments, which are illustrated as examples in the annexed drawings wherein:

FIG. 1 shows a perspective view of a section of a microstrip transmission line in accordance with the present invention, FIG. 2 shows a cross section of said transmission line along plan II—II of FIG. 1 coupled with a dielectric resonator in a metal housing and shielding box, FIG. 3 shows an alternative planar structure which can be accomplished by using a transmission line in accordance with the invention in a version suitable for coupling on the outer edge of the insulating support, FIG. 4 shows a cross section of said planar structure along plan IV—IV of FIG. 3, and FIG. 5 shows the equivalent electric diagram of the transmission lines illustrated in the above figures.

In FIG. 1 there is illustrated a structure 1 which supports a section of transmission line made up of a conductive path 2, of a metal ground plane 3, and of an interposed insulating support 4 along which the conductive path 2 is laid in a substantially central position.

The conductive path 2 includes an enlarged area 5 under which the ground plane 3 has a plurality of narrow slots 6 parallel to or directed perpendicularly to the conductive path 2.

In this embodiment the slots 6 are all equal and placed at a fixed spacing which is selected in such a manner as to be a small fraction of the wavelength of the transmitted signal, e.g. one tenth. Depending on the expected use said slots can however be different and differently arranged.

The transmission line shown in FIG. 1 lends itself to coupling with a dielectric resonator located either above or below said line. A possible structure with superimposed planes is shown in FIG. 2 wherein reference number 7 indicates the dielectric resonator and reference number 8 indicates a metal housing and shielding box provided with either a cylindrical or prismatic recess 9 with a superimposed housing or supporting recess 10 for the structure 1.

The embodiment shown in FIGS. 3 and 4 differs from that shown in FIGS. 1 and 2 in that the enlarged area 5 of the conductive path 2 and the transverse slots 6 are shifted to the side edge of the insulating support 4. The dielectric resonator 7 can thus be arranged at the side of instead of above or below the structure 1 in order to achieve a planar configuration inside a box 8.

As shown in FIG. 4 the box 8 has an undercutting 11 beneath the structure 1 in order to avoid short-circuiting the transmission line.

In both the embodiments described the conductive path 2 is coupled with the dielectric resonator 7 through the slots 6. In other words the conductive path 2 couples with the slots 6 and said slots 6 couple with the dielectric resonator 7.

In electrical terms the equivalent diagram is as shown in FIG. 5 where the individual slots 6 constitute concentrated inductances connected together in series by the ground plane 3 and intersecting with the microstrip 2. In this manner the inductance per unit of length of the line is increased as compared to the conventional unbroken line. To hold the characteristic impedance steady it is necessary and sufficient to increase the width of the conductive path 2 as shown at the enlarged area 5.

What is claimed is:

1. A microstrip transmission line for coupling to a dielectric resonator comprising a conductive path and a metallic ground plane applied to opposite faces of an insulating support characterized in that the ground plane has a plurality of parallel slots placed under said conductive path and transversely thereto for coupling the resonator at only a resonant frequency and not disturbing the transmission line at other frequencies, the conductive path being provided with an enlarged portion arranged above the plurality of parallel slots.

2. A transmission line in accordance with claim 1 characterized in that said slots are directed perpendicularly to said conductive path.

3. A transmission line in accordance with claim 1 characterized in that said conductive path develops substantially in a central position in relation to said insulating support for coupling to a resonator placed above or below the transmission line.

4. A transmission line in accordance with claim 1 characterized in that said conductive path develops along the edge of the insulating support for coupling to a resonator place beside said transmission line.

5. A transmission line in accordance with claim 1 characterized in that said slots all have the same width.

6. A transmission line in accordance with claim 1 characterized in that said slots are all located at the same distance from each other.

7. A transmission line in accordance with claim 1 characterized in that the pitch of said slots is smaller than the wavelength of a signal transmitted on said line.

8. A transmission line in accordance with claim 1 characterized in that said slots all have the same width and all are located at the same distance from each other, and in that the pitch of said slots is smaller than the wavelength of a signal transmitted on said line.

* * * * *